US009739070B2

(12) United States Patent
Bushore

(10) Patent No.: US 9,739,070 B2
(45) Date of Patent: Aug. 22, 2017

(54) METHODS AND APPARATUSES OF SUPPORTING AND BRACING A UTILITY POLE

(71) Applicant: Kevin M. Bushore, Bonnyville (CA)

(72) Inventor: Kevin M. Bushore, Bonnyville (CA)

( * ) Notice: Subject to any disclaimer, the term of this patent is extended or adjusted under 35 U.S.C. 154(b) by 0 days.

(21) Appl. No.: 14/640,721

(22) Filed: Mar. 6, 2015

(65) Prior Publication Data

US 2015/0184415 A1 Jul. 2, 2015

Related U.S. Application Data

(63) Continuation-in-part of application No. 13/738,122, filed on Jan. 10, 2013, now Pat. No. 9,103,090.

(51) Int. Cl.

| | |
|---|---|
| ***E04H 12/20*** | (2006.01) |
| ***E04H 12/08*** | (2006.01) |
| ***E04C 3/30*** | (2006.01) |
| ***E02D 27/42*** | (2006.01) |
| *E04H 12/22* | (2006.01) |
| *E04H 12/24* | (2006.01) |

(52) U.S. Cl.

CPC ..... *E04H 12/20* (2013.01); *E02D 27/42* (2013.01); *E04C 3/30* (2013.01); *E04H 12/2238* (2013.01); *E04H 12/2253* (2013.01); *E04H 12/24* (2013.01)

(58) Field of Classification Search

CPC ..... E04H 12/20; E04H 12/08; E04H 17/22; E04H 17/08; E04H 12/2238; E04H 12/2253; E04H 12/2276; E04C 3/00; E04C 3/30

USPC ..... 52/153, 154, 155, 159, 160, 161, 170, 52/151, 152, 150, 146, 506.08, 506.06, 52/127.2, 127.1, 745.21

See application file for complete search history.

(56) References Cited

U.S. PATENT DOCUMENTS

| | | | |
|---|---|---|---|
| 213,932 | A | 4/1879 | Powell |
| 278,220 | A | 5/1883 | Caeson |
| 492,520 | A | 2/1893 | Hedges |
| 645,372 | A | 3/1900 | Paldi |
| 658,779 | A | 10/1900 | Huntress |
| 724,644 | A | 4/1903 | Winslow |
| 785,270 | A | 3/1905 | Reams |
| 825,158 | A | 7/1906 | Rousseau et al. |
| 826,124 | A | 7/1906 | Soseman |
| 856,725 | A | 6/1907 | Roach |
| 866,303 | A | 9/1907 | Reynolds |
| 877,268 | A | 1/1908 | Van Buren |

(Continued)

OTHER PUBLICATIONS

"Week 13: Distribution: Equipment", Electrical Power Plant Design [online], Jul. 2012, http://engr.freeservers.com/ppd/d/302.html.

(Continued)

*Primary Examiner* — Phi A

(57) ABSTRACT

A bracket has: a plate having bolt holes and a utility pole mount; a clamp secured to the plate, the clamp comprising cooperating screw pile shaft receiving parts having laterally extending flanges, the flanges having fastener receiving openings for securing the clamp around a screw pile. A combination has: a bracket; a utility pole extended from a ground surface, in which the plate is bolted to the utility pole through the bolt holes in the plate; and a screw pile fastened to the clamp and penetrating the ground surface.

20 Claims, 10 Drawing Sheets

(56) References Cited

U.S. PATENT DOCUMENTS

| | | | | |
|---|---|---|---|---|
| 903,686 | A | 11/1908 | Devany | |
| 925,940 | A | 6/1909 | McClintock | |
| 931,425 | A | 8/1909 | Hile | |
| 1,271,751 | A * | 7/1918 | Novess | E04H 17/22 52/150 |
| 1,679,297 | A | 1/1928 | Ehrler | |
| 1,690,955 | A | 10/1928 | Gilbert | |
| 1,719,352 | A | 7/1929 | Young | |
| 1,722,352 | A * | 7/1929 | Rawley | E04H 12/2253 52/152 |
| 1,811,217 | A | 6/1931 | Spaugh | |
| 1,984,767 | A | 12/1934 | Shaffert | |
| 2,510,717 | A | 6/1950 | Roos | |
| 2,653,688 | A | 9/1953 | Gordon | |
| 2,903,856 | A | 9/1959 | Dean | |
| 3,027,686 | A | 4/1962 | Oates | |
| 3,546,885 | A | 12/1970 | Pogonowski | |
| 3,809,346 | A | 5/1974 | Jackson | |
| 3,874,625 | A | 4/1975 | Hansen | |
| 4,068,427 | A * | 1/1978 | Camardo | 52/127.2 |
| 4,074,481 | A | 2/1978 | Lang | |
| 4,083,156 | A | 4/1978 | Tye | |
| 4,242,822 | A | 1/1981 | Black | |
| 4,268,066 | A | 5/1981 | Davis | |
| 4,327,534 | A | 5/1982 | Mastalski | |
| 4,455,795 | A | 6/1984 | Cole | |
| 4,889,222 | A | 12/1989 | Kanamori | |
| 5,038,536 | A | 8/1991 | De Mendoza Sans | |
| 5,042,780 | A | 8/1991 | Yearwood | |
| 5,233,809 | A | 8/1993 | Gropper | |
| 5,253,839 | A | 10/1993 | McClure | |
| 5,291,709 | A | 3/1994 | Vranjesevic | |
| 5,317,844 | A | 6/1994 | Legler | |
| 5,343,667 | A | 9/1994 | Peden | |
| 5,356,101 | A | 10/1994 | Malloy | |
| 5,564,235 | A | 10/1996 | Butler | |
| 5,704,171 | A | 1/1998 | Ruff | |
| 5,791,635 | A | 8/1998 | Hull et al. | |
| 5,794,387 | A * | 8/1998 | Crookham | F21V 21/36 52/122.1 |
| 5,956,906 | A * | 9/1999 | Berich et al. | 52/149 |
| 6,112,475 | A | 9/2000 | Truitt | |
| 6,230,449 | B1 | 5/2001 | Colvin, Jr. | |
| 6,298,618 | B1 | 10/2001 | Lawson | |
| 6,419,201 | B1 | 7/2002 | Hughes, Jr. et al. | |
| 6,439,344 | B1 | 8/2002 | Cole | |
| 6,468,002 | B1 * | 10/2002 | Gregory et al. | 405/230 |
| 6,655,097 | B1 * | 12/2003 | Poolaw | 52/127.2 |
| 6,684,580 | B1 | 2/2004 | Hull | |
| 6,776,379 | B2 * | 8/2004 | Sherer | B65D 25/24 248/150 |
| 6,931,805 | B2 | 8/2005 | Gregory | |
| 6,976,339 | B1 | 12/2005 | Riccio | |
| 6,986,495 | B2 | 1/2006 | Pinkleton | |
| 7,040,059 | B2 | 5/2006 | Hodsdon | |
| 7,059,095 | B1 | 6/2006 | Stevens et al. | |
| 7,073,296 | B2 | 7/2006 | Gregory | |
| 7,434,361 | B1 | 10/2008 | Taylor | |
| 7,665,252 | B2 | 2/2010 | Lang | |
| 7,739,842 | B1 * | 6/2010 | Hodsdon et al. | 52/127.2 |
| 7,913,463 | B2 | 3/2011 | Russel | |
| 7,993,107 | B2 | 8/2011 | Gevers | |
| 8,245,458 | B2 * | 8/2012 | Johnson et al. | 52/152 |
| 8,322,106 | B2 | 12/2012 | Simmons | |
| 8,511,010 | B2 * | 8/2013 | Grossman | E04H 7/30 52/194 |
| 8,752,670 | B2 * | 6/2014 | Holman | A01M 31/02 182/187 |
| 8,991,777 | B2 * | 3/2015 | Madril | 248/206.5 |
| 2001/0045079 | A1 | 11/2001 | Nichols | |
| 2002/0073634 | A1 | 6/2002 | Bolinger | |
| 2002/0088187 | A1 | 7/2002 | Howard et al. | |
| 2003/0015633 | A1 * | 1/2003 | Pyanowski | H01Q 1/12 248/146 |
| 2005/0072066 | A1 | 4/2005 | Leslie | |
| 2006/0207215 | A1 | 9/2006 | Bruno | |
| 2007/0084137 | A1 | 4/2007 | Pasto | |
| 2007/0175174 | A1 * | 8/2007 | Bruno | 52/745.12 |
| 2008/0141598 | A1 | 6/2008 | Cook | |
| 2008/0202043 | A1 | 8/2008 | Marshall | |
| 2010/0218438 | A1 | 9/2010 | Sollars | |
| 2011/0047895 | A1 | 3/2011 | Finch | |
| 2012/0096778 | A1 | 4/2012 | Bauletti | |

OTHER PUBLICATIONS

"Utility Industry Anchor Design and Maintenance Manual", Earth Contact Products LLC, Jun. 2011.

"Helical Light Pole Foundations", ECP Utility [online], Oct. 2012, http://www.ecputility.com/Light_Pole_Foundations.asp.

"Pole Clip", Hubbell Power Systems, Inc. [online], Oct. 2012, http://www.hubbellpowersystems.com/anchoring/pole-support/pole-clip.

"Foundation Anchors", Pelco Utility Products Inc., Jul. 2006.

* cited by examiner

METHODS AND APPARATUSES OF SUPPORTING AND BRACING A UTILITY POLE

CROSS-REFERENCE TO RELATED APPLICATIONS

This application is a continuation-in-part of U.S. patent application Ser. No. 13/738,122 filed Jan. 10, 2013.

TECHNICAL FIELD

This document relates to methods and apparatuses of supporting and bracing a utility pole.

BACKGROUND

Utility poles are used to support overhead power lines and other public utilities. Traditional methods of supporting a utility pole include using one or more guy wires at the upper end of the utility pole to laterally brace the upper end of the utility pole in the vertical position. In some environments, such as soft soils, guy wires may be ineffective in bracing utility poles. Over time, wind loading on insufficiently braced utility poles has caused utility pole tipping, resulting in the weight of the conductor failing the line.

SUMMARY

A bracket comprising: a plate having bolt holes and a utility pole mount; a clamp secured to the plate, the clamp comprising cooperating screw pile shaft receiving parts having laterally extending flanges, the flanges having fastener receiving openings for securing the clamp around a screw pile.

A combination comprising: a bracket; a utility pole extended from a ground surface, in which the plate is bolted to the utility pole through the bolt holes in the plate; and a screw pile fastened to the clamp and penetrating the ground surface.

A combination comprising: a bracket comprising a plate and a clamp; a utility pole extended from a ground surface, in which the plate is secured to the utility pole; a screw pile fastened to the clamp and penetrating the ground surface along an axis that is parallel to a utility pole axis; and a lateral stabilizer connected to the utility pole; in which the utility pole is positioned above or partially within unstable soil, and the unstable soil is one or more of permafrost, soils with ice lensing, muskeg, soil with organics, water saturated soils, silts, sands, peat, hog fuel, wood chips, and weak alluvial soils.

A method is disclosed of supporting a utility pole that is erected relative to a ground surface and defines a utility pole axis, the method comprising: inserting a first screw pile and a second screw pile below the ground surface; and connecting each of the first screw pile and the second screw pile to the utility pole; in which the first screw pile is parallel to the utility pole axis and the second screw pile is at a non zero angle to the utility pole axis.

A method is disclosed of bracing a utility pole that is erected relative to a ground surface and defines a utility pole axis, in which a first screw pile is connected to the utility pole and extended below the ground surface parallel to the utility pole axis, the method comprising: inserting a second screw pile below the ground surface at a non zero angle to the utility pole axis; and connecting the second screw pile to the utility pole.

An apparatus is disclosed comprising: a utility pole erected relative to a ground surface and defining a utility pole axis; a first screw pile connected to the utility pole and extended, parallel to the utility pole axis, from the utility pole to below the ground surface; and a second screw pile connected to the utility pole and extended, at a non zero angle to the utility pole axis, from the utility pole to below the ground surface.

In various embodiments, there may be included any one or more of the following features: At least one of the cooperating screw pile shaft receiving parts is fused to the plate. The utility pole mount is a channel formed by the plate and having a C-shaped cross-sectional shape. The clamp defines a screw pile shaft axis, which is parallel to a utility pole axis defined by the channel. A series of stiffeners located within the channel. Each stiffener has a utility pole contacting edge that is curved to follow a portion of an outer circumferential surface of a utility pole. Each stiffener comprises a utility pole penetrating pin. The clamp comprises a series of clamps axially aligned and spaced from one another along the plate. A screw pile thrust stop secured to the plate. The screw pile thrust stop comprises a plate positioned across a screw pile shaft axis defined by the clamp. Bolts securing the bracket to the utility pole or fastening the screw pile to the clamp are installed to an installation torque at or above 150 Newton meters. The utility pole is positioned above or partially within unstable soil, and the unstable soil is one or more of permafrost, soils with ice lensing, muskeg, soil with organics, water saturated soils, silts, sands, peat, hog fuel, wood chips, and weak alluvial soils. The screw pile is a first screw pile, and further comprising a second screw pile penetrating the ground surface and secured by bracket to the utility pole at a base of the utility pole above the ground in a batter pile configuration relative to the utility pole, in which the first screw pile is mounted parallel to a utility pole axis. The second screw pile comprises plural second screw piles secured at various radially spaced locations about a utility pole circumference. The first screw pile and the second screw pile are both screw piles sized for the utility pole. The first screw pile and the second screw pile are helical piers. Inserting comprises screwing. Inserting comprises monitoring torque applied to the second screw pile during insertion and stopping insertion after the torque applied exceeds a predetermined value. Connecting comprises connecting the second screw pile to the utility pole through a bracket. The soil adjacent the utility pole is unstable soil. The unstable soil is one or more of permafrost, soils with ice lensing, muskeg, soil with organics, water saturated soils, silts, sands, peat, hog fuel, wood chips, and weak alluvial soils. The second screw pile is connected at a vertical connection distance from the ground surface and at an angle with respect to the utility pole sufficient to laterally brace the upper end of the utility pole. The method may include erecting the utility pole relative to the ground surface. The first screw pile is connected adjacent to a base of the utility pole. Connecting further comprises connecting the second screw pile to restrict relative movement, in all axes of direction, between the utility pole and the second screw pile. A bracket connects the second screw pile and the utility pole. The bracket has a guide, and the bracket has at least a configuration in which the guide allows relative axial displacement between the bracket and the second screw pile. The utility pole is a utility pole.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Figure 1:
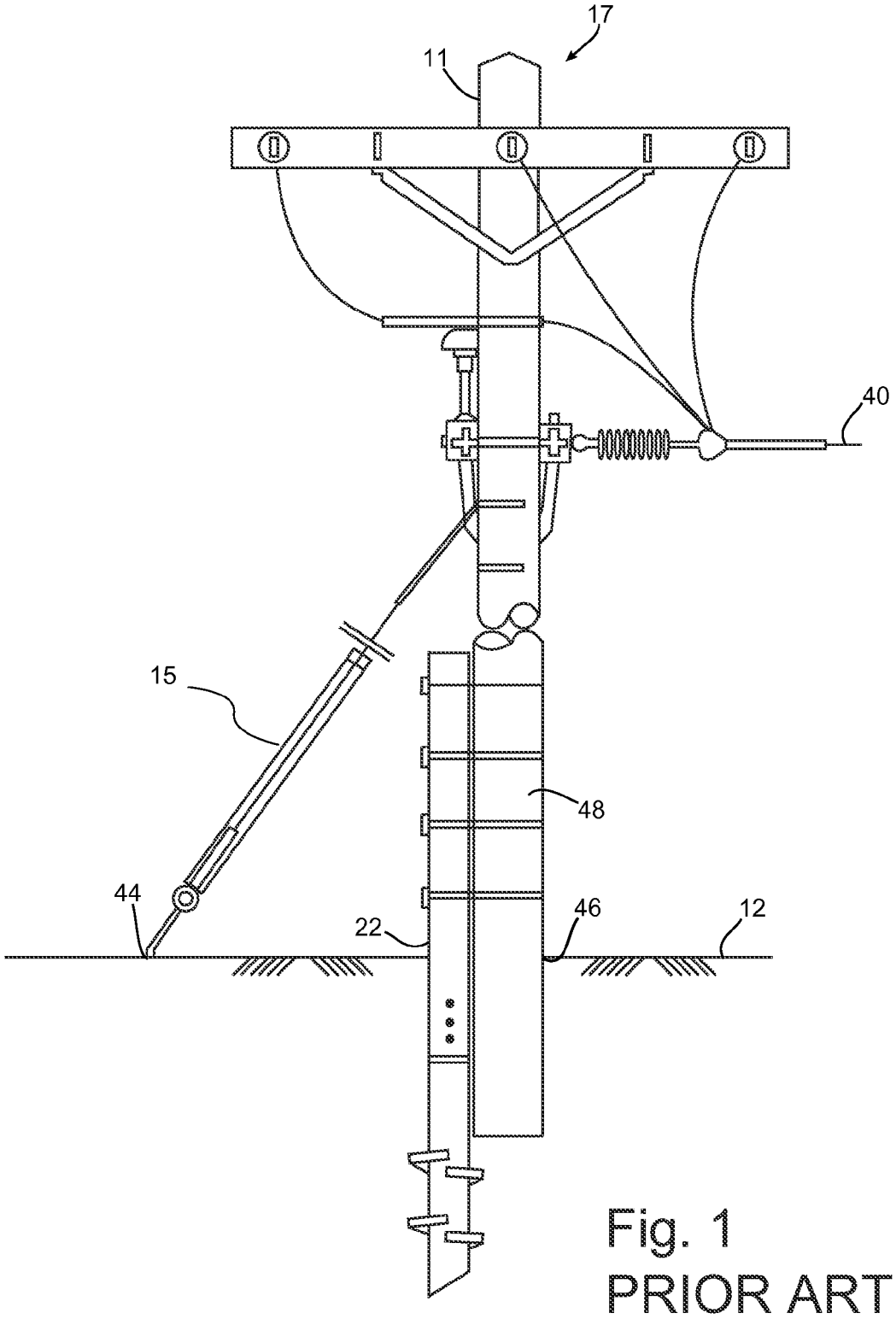
Fig. 1 PRIOR ART
FIG. 1 is a side view of a known method of supporting a utility pole with a screw pile and guy wire.

Referring to FIG. 1, utility poles 11 are used to support overhead power lines 40 and various other public utilities, such as cable, fiber optic cable, and related equipment such as transformers and street lights. Utility poles may be referred to as telephone, power, hydro, telegraph, or telegraph posts or utility poles, depending on application. Electrical cable may be routed overhead as an inexpensive way to keep it insulated from the ground 12 and out of the way of people and vehicles. Utility poles may be made of wood, metal, concrete, composites such as fiberglass, or other suitable materials. Utility poles may be fifty or ninety feet tall in some cases, and may support hundreds of feet of wire. Utility poles are often placed in areas where fences and other infrastructure cannot be placed due to unstable soil conditions. A poorly supported utility pole may fall over and cause a forest fire or other devastation.

FIG. 1 shows a depiction of a utility pole 11. Utility pole 11 may extend below ground surface 12, but is founded by a vertically drilled screw pile, such as a helical pier 22. Pier 22 is driven into ground surface 12 adjacent and parallel to utility pole 11, and secured to a base 48 of utility pole 11 using bolts 31 past through holes (not shown) blown through utility pole 11 and pier 22. An upper end 17 of utility pole 11 may be laterally braced using one or more guy wires 15, which are anchored below ground surface 12 at guy insertion points 44 spaced a sufficient lateral distance from a utility pole entry point 46 in ground surface 12. Although shown in a 60-90 degree cable installation, guy wires are similarly used in other utility pole 11 cable installations, such as tangent or dead end cable installations.

Figure 2:
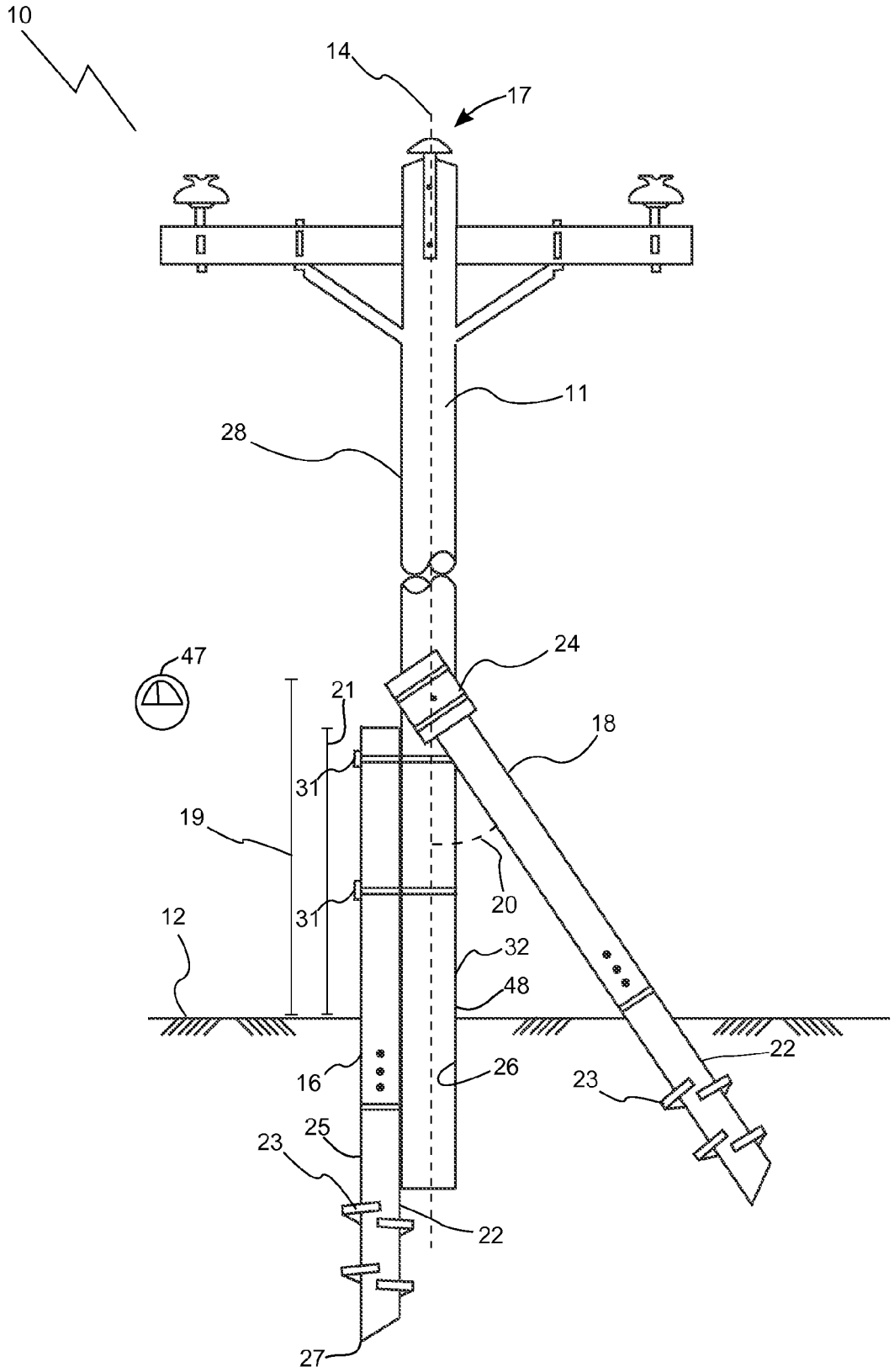
FIG. 2 is a side view illustrating a system and method of supporting or bracing a utility pole.

As seen in FIG. 2, in particular embodiments, an apparatus 10 is illustrated. Apparatus 10 may include a utility pole 11, a first screw pile 16, and a second screw pile 18. Utility pole 11 may be erected relative to a ground surface 12 to define a utility pole axis 14. The first screw pile 16 may be connected to the utility pole 11, for example using a series of bolts 31. Screw pile 16 may also be extended, parallel to the utility pole axis 14, for example vertically, from the utility pole 11 to below the ground surface 12 as shown. The second screw pile 18 may be connected to the utility pole 11, for example using a suitable securing mechanism such as a bracket 24. Screw pile 18 may be extended, at a non-zero angle 20 to the utility pole axis 14, from utility pole 11 to below the ground surface 12 as shown.

The use of the second screw pile 18 may give tensile lateral support to the utility pole 11 similar to a guy wire, but also gives compression support to the utility pole 11. The first screw pile 16 and the second screw pile 18 may both be screw piles sized for the utility pole 11 as shown. Even though screw pile 16 is illustrated as founding the utility pole, screw pile 18 is also of sufficient dimensions and strength to found the utility pole 11 by occupying the founding position of screw pile 16. This means the same equipment can be used to install both screw piles 16 and 18. Using one or more screw pile 18 is advantageous because screw piles are cheaper and more efficient to install than are guy wires. Installing guy anchors requires use of specialized tools as well as the cost of the guy anchor and wire itself.

In some embodiments, the first screw pile 16 and the second screw pile 18 may be helical piers 22 as shown. Helical piers 22 may comprise a shaft 25 with one or more helical flights 23 protruding laterally from the shaft 25 at or near a pointed drive end 27 of the pier 22, or at various locations along the length of the shaft 25. Screw piles include ground screws, foundation anchors, anchor rod anchors, rod drive anchors, and helical piles. Using screw pile 18 may also eliminate the need for guying the utility pole 11. Elimination of guying is advantageous for reasons given above and because guy wires give the utility pole 11 a larger lateral footprint than do screw piles 18, compare footprints 103 and 104 in FIG. 18 for example. A smaller footprint is particularly useful if space around utility pole 11 is restricted, for example if located adjacent roadways, pipelines, or thick vegetation.

Figure 3:
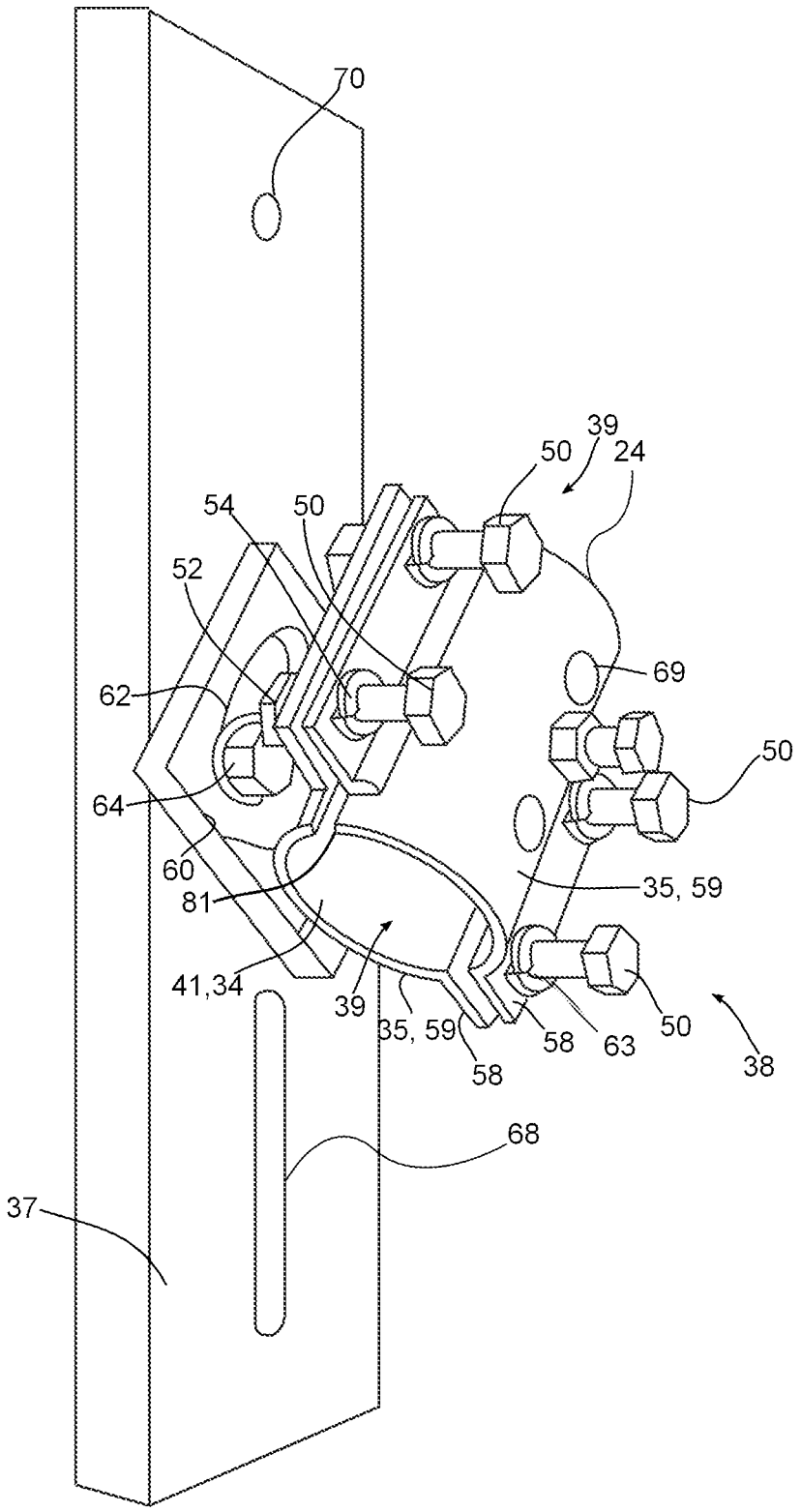
FIG. 3 is a perspective view of a bracket used in the method of FIG. 1.
Figure 4:
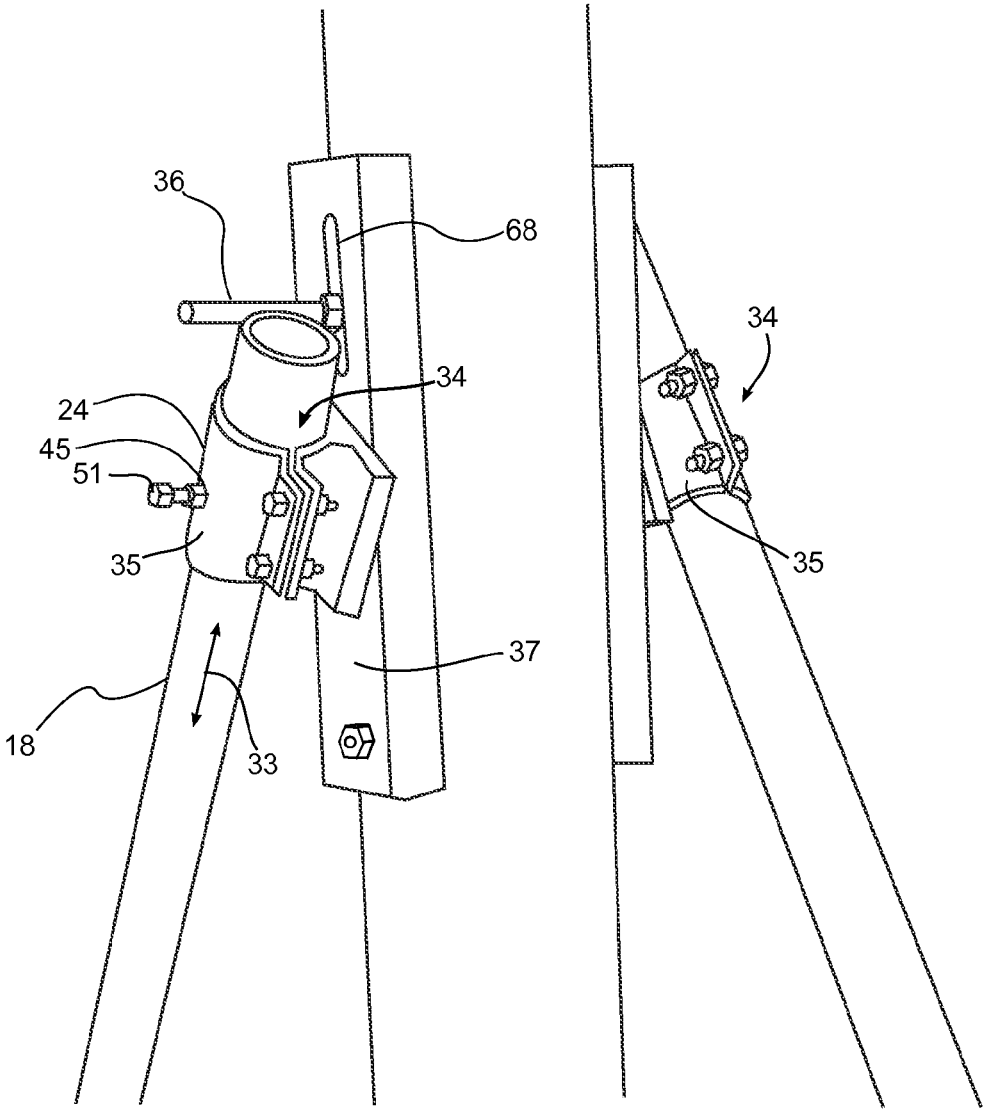
FIG. 4 is a perspective view of a pair of the brackets of FIG. 3 connected to the utility pole of FIG. 1 and each supporting a screw pile.
Figure 5:
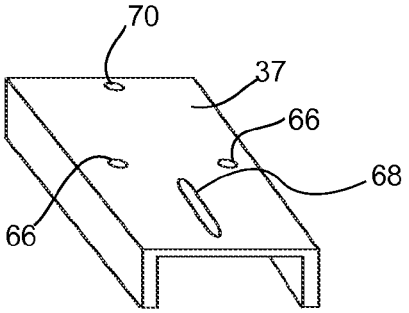
FIG. 5 is a perspective view of a utility pole mounting plate taken from the bracket of FIG. 3.

As shown in FIGS. 3-7, the apparatus may comprise a bracket 24 connecting one or more of the screw piles, for example screw pile 18, to the utility pole 11. The bracket 24 may be designed to withstand forces greater than the breaking strength of the utility pole 11. Bracket 24 may be formed of one or more parts, for example a base, such as a plate 37, and a screw pile mount such as a clamp 38. The plate 37 may have bolt holes, such as holes 66 and 70 (FIG. 5), and a utility pole mount such as a channel 65 formed by the plate 37 and having a C-shaped cross-sectional shape (FIG. 5).

The clamp 38 may be secured to the plate 37, and may comprise cooperating screw pile shaft receiving parts 35, for example semi-cylindrical part 35 as shown. Parts 35 may cooperate to form a guide, for example an axial passageway 41 sized to fit screw pile 18 and open at both axial ends 39 (FIGS. 3-4). Passageway 41 allows the bracket 24 to have at least a configuration in which the guide 34 allows relative axial displacement between the bracket 24 and the second screw pile 18. Screw pile 18 may be axially displaced through bracket 24 along direction lines 33 as shown in FIG. 4, at least before being secured into place in the bracket 24.

Screw pile receiving parts 35 may be connected together by a suitable mechanism. For example, parts 35 may have laterally extending flanges 58, for example laterally extended from the edges 81 of C-shaped screw pile contacting portions 59. The flanges 58 may have fastener receiving openings, such as bolt holes 63, for securing the clamp around a screw pile, for example using bolts 50, nuts 52, and spring clips 54, passing through cooperating flanges 58 as shown (FIG. 3). A further bolt 51 may be passed through an opening 45 in portion 59 to contact and secure screw pile 18 from axial movement once positioned within bracket 24 (FIG. 4).

Figure 6:
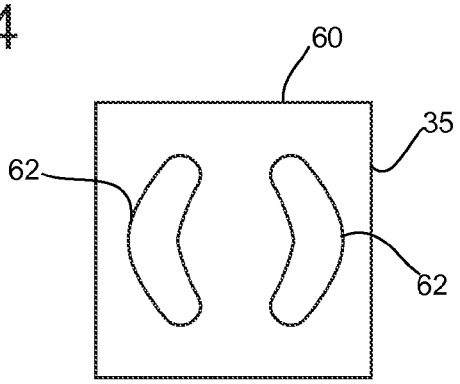
FIG. 6 is bottom plan view of the bracket of FIG. 3.
Figure 7:
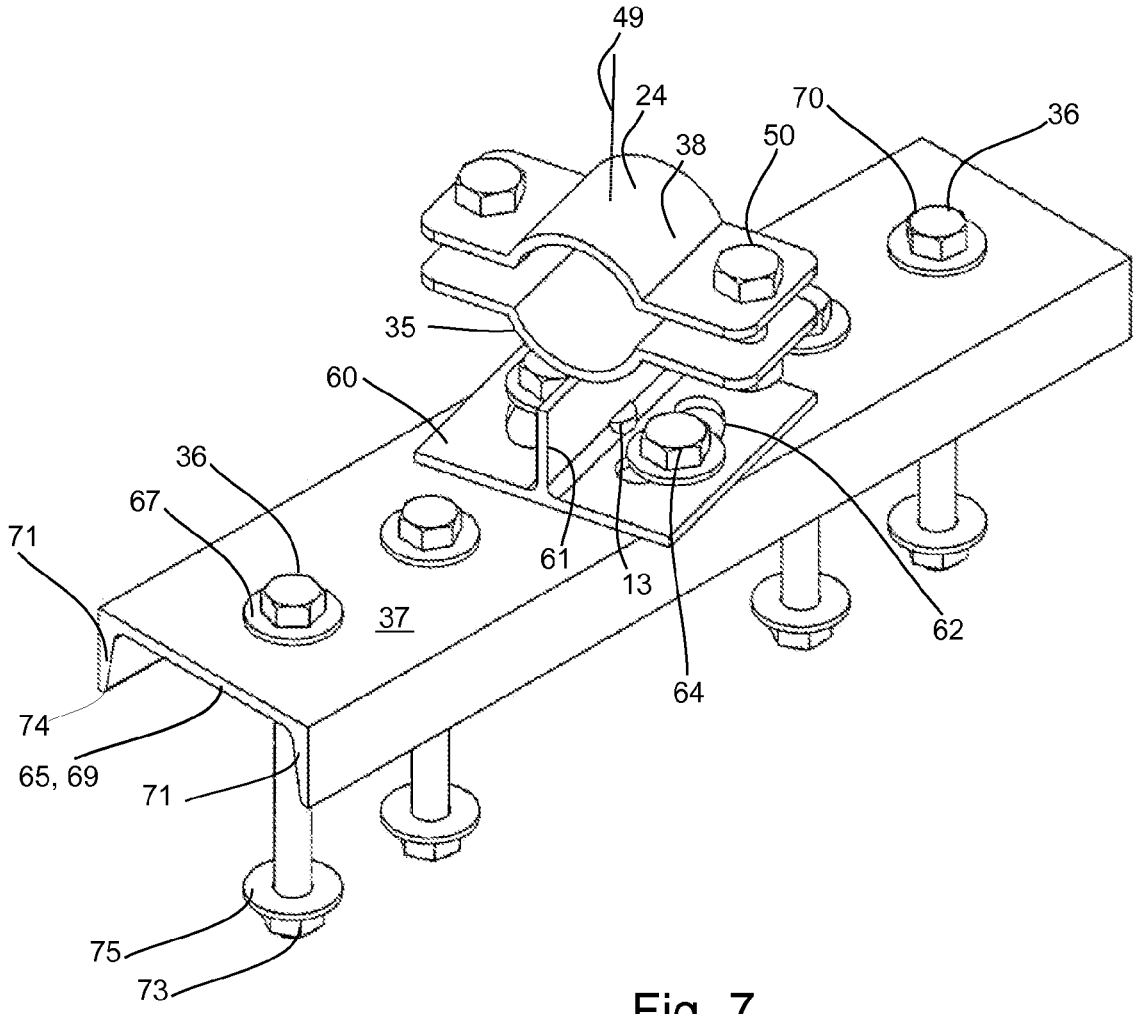
FIG. 7 is a perspective view of an embodiment of a bracket used in the method of FIG. 1.

One or more of screw pile receiving parts 35 may connect to plate 37, for example through a base plate 60 and flange plate 61 (FIG. 7). Clamp 38 may also be adapted to pivot or move relative to plate 37. Pivoting may be accomplished via a suitable pivoting mechanism. For example, base plate 60 may include one or more C-shaped holes 62 that allow one or more bolts 64 to loosely secure plate 60 to plate 37 through bolt holes 66, while allowing bracket 24 to pivot, for example about an axis 49 perpendicular to the plate 37 (FIGS. 3, and 5-6). In other cases, plate 37 includes C-shaped holes 62. Plate 37 may also be designed to allow relative movement with utility pole 11 once partially secured to utility pole 11, to permit the fine-tuning of the position of the bracket 24 prior to securing to the utility pole 11. For example, plate 37 may include a pair of holes, one being a slide hole 68 and the other being a standard bolt hole 70 (FIGS. 3 and 5). Once a bolt 36 is loosely passed through slide hole 68 into utility pole 11, bracket 24 may be vertically moved relative to utility pole 11 as far as permitted by the dimensions of slide hole 68. Once in position, bolts 36, 72, 64, and 51 may be fully secured to prevent further relative movement. These and other mechanisms may be used to allow relative movement between bracket 24 and utility pole 11 or bracket 24 and screw pile 18 to allow fine positional adjustments after rough positioning and partial securing. Allowing relative movement between utility pole 11 and bracket 24 makes installation of apparatus 10 more convenient because small errors in initial positioning can be corrected without having to remove the bracket 24 from the utility pole 11. For example, if screw pile 18 is driven into ground surface 12 first, and then bracket 24 installed partially upon utility pole 11, slide hole 68 and bolt 36 allow the proper vertical height of bracket 24 to be obtained after partially securing to utility pole 11. Similarly, holes 62 allow bracket 24 to assume the proper angle for receiving screw pile 18 and connecting to utility pole mount 37.

Referring to FIG. 2, a method of supporting a utility pole 11 is also illustrated. The method may begin with utility pole 11 being erected relative to a ground surface 12 and defining a utility pole axis 14. In a first stage, a first screw pile 16 and a second screw pile 18 may be inserted, for example by screwing, below the ground surface 12. In a second stage, each of the first screw pile 16 and the second screw pile 18 may be connected to the utility pole 11. After connection, the first screw pile 16 may be parallel to the utility pole axis 14 and the second screw pile 18 may be at a non-zero angle 20 to the utility pole axis 14.

As described above inserting may comprise screwing, for example if helical piers 22 are used. Screwing is beneficial because it minimally disrupts the ground and thus negates the need to allow the ground to settle after installation. When working with unstable soils, the ability to avoid excavation and backfilling followed by settling is further advantageous, as the strength of the soil is already weak to begin with.

Inserting may further comprise monitoring torque applied to the first or second screw pile during insertion and stopping insertion after the torque applied exceeds a predetermined value. The torque may be monitored directly, through for example a torque gauge 47, or indirectly, for example by counting the number of rotations. An exemplary predetermined torque value may be 1000 foot pounds averaged over 3 feet, although other suitable torques may be used depending on application. In some cases the predetermined torque may be selected to make the foundation as strong as if the pole 11 were mounted in firm soil conditions. Monitoring torque gives a user an objective way to measure the holding strength of the screw pile 18. By comparison, there is no way of testing the holding strength of a guy anchor once installed, despite the requirement in many jurisdictions that holding strength must be of a predetermined minimum value.

Inserting screw pile 18 to a predetermined torque means that soil strength is not be a factor because the pull-out strength is determined by the applied torque. If after insertion, the predetermined torque value has not been met, extension screw pile sections can be added to screw pile 18 to increase the length of screw pile 18 so that enough screw pile 18 can be inserted into ground 12 to meet the predetermined torque value. As shown in FIGS. 2-5, in particular embodiments, connecting may further comprise connecting the first or second screw pile to the utility pole through a bracket 24.

Figures 18, 19:
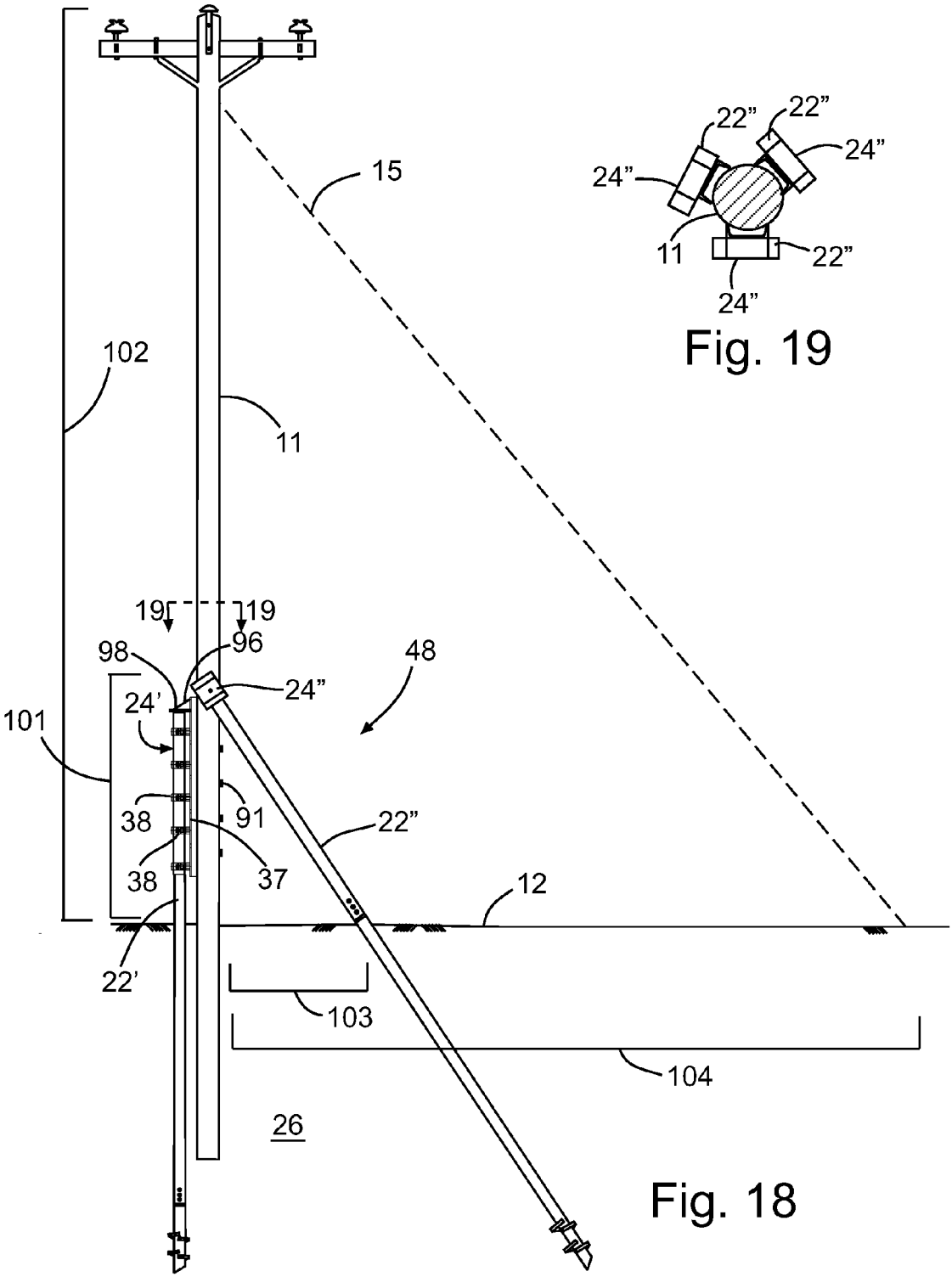
FIG. 18 is a side elevation view of a system and method of supporting a utility pole with the brackets of FIGS. 7 and 8.
FIG. 19 is a section view taken along the 19-19 section lines in FIG. 18.

The utility pole 11 may itself be inserted into the ground 12, or may be positioned on top of or above the ground 12. In some embodiments, either the first screw pile 16 or the second screw pile 18 or both may connect to the utility pole 11 above ground 12, for example by connecting to base 48 of utility pole 11, the base 48 being contrasted with the middle 28 and upper end 17 portions of utility pole 11. As shown in FIG. 18, the base 48 may only have a height 101 that is a fraction of the height 102 of the utility pole 11 itself, with height 101 being within reach of an adult in most cases. Thus, installation of the bracket 24 and screw pile 22 can be accomplished without special ladders, cherry pickers, or climbing. In other embodiments the first screw pile 16 or the second screw pile 18 or both may connect to the utility pole 11 below ground 12.

The soil 26 adjacent to the utility pole 11 may be unstable soil 26, such as one or more of permafrost, soils with ice lensing, muskeg, soil with organics, water saturated soils, silts, sands, peat, hog fuel, wood chips, and weak alluvial soils. Soil strength may be determined using a geotechnical analysis, for example incorporating a standard penetration test. A worker may dig a hole for utility pole 11, log geotechnical information for that hole, and fill out a log chart. If there is a meter or more of unstable or weak soil at the surface, vertical stabilization and lateral stabilization may be used as described in this document.

Referring to FIG. 2, the first and second screw piles 16 and 18 may be connected at a vertical connection distance 19 from the ground surface 12 and at an angle 20 with respect to the utility pole sufficient to laterally brace the upper end 17 of the utility pole. For example distance 19 may be 1-2 meters above grade, for example 1.5 meters above grade, although other distances 19 may be used. Vertical connection distance 19 may be positioned above base height 21 of screw pile 16 in some cases. For example, angle 20 may be thirty to sixty degrees, although other angles may be used.

The method may further comprise erecting utility pole 11 relative to the ground surface 12, for example before, during, or after the first stage and before or during the second stage. In some embodiments, the first screw pile 16 may be connected adjacent to a base 48 of the utility pole 32. In an exemplary embodiment, connecting may further comprise connecting the second screw pile 18 to restrict relative movement, in all axes of direction, between the utility pole 11 and the second screw pile 18.

In another embodiment, a utility pole 11 may be braced, the utility pole 11 already having a first screw pile 16 connected to the utility pole 11 and extended below the ground surface parallel to the utility pole axis 14. Second screw pile 18 may be inserted below the ground surface 12 at a non-zero angle 20 to the utility pole axis 14. The second screw pile 18 may then be connected to the utility pole 11. Such a method allows existing installations comprising utility pole 11 founded by screw pile 16 to be improved via installation of screw pile 18 in the manner described. Such a method may be used to laterally brace utility pole installations in areas of unstable soils. In other cases, no vertical first pile 16 may be present or connected to utility pole 11, such that the second screw pile 18 is the only such pile used to stabilize the utility pole 11.

Referring to FIG. 7 another embodiment of a bracket 24 is illustrated, with plate 37 and screw pile receiving parts 35 provided as independent pieces. Extended from plate 37 is a neck plate 61 that may be connected, for example by fillet welding, to receiving part 35. The neck 61-plate 60 connection may be made before or after plate 37 is connected to the utility pole. A swivel pin 13 may be mounted between plate 37 and plate 60 to assist in aligning plate 60 and plate 37 together before securing bolts 64. The swivel pin 13 may be provided as part of plate 60, plate 37, or as an independent part. To install the bracket 24 to a utility pole 11, holes (not shown) are drilled through the utility pole 11, and bolts 36 passed through corresponding bolt holes 70 in the plate 37 and the holes in the utility pole 11. Nuts 73 and washers 67 may be used to complete the bolted connection to the utility pole 11. The utility pole mount of plate 37 is a channel 65 formed by the plate 37 and having a C-shaped cross-sectional shape, for example defined by a base part 69 and side walls 71. The width of side walls 71 may increase from a utility pole contacting edge 74 to base part 69, to reinforce the plate 37. The edges 74 may be textured (not shown) to grip the utility pole 11 in use.

In some cases the disclosed methods and apparatuses provide a buttress pile in a manner that it will work for the compression holding forces and also the opposing tension holding forces at the base of a power pole, so as to provide a base support to the pole in soft soil. Such a structure eliminates the need to guy and anchor in two opposing directions the top of the structure. In some cases a power pole is provided the support at the base of the structure that it could obtain if it were set in stable soil conditions, such as dry compactable clay, albeit using a relatively decreased footprint while taking advantage of the compression and tension holding capacity, and with a footprint on one side of the power pole only in some cases. Conventional guying requires two opposing anchors attached at the top of a pole and the footprint would be a minimum of 6-10 meters (3-5 meters either side).

FIG. 1 discloses a conventional way to laterally brace a utility pole anchored by a helical pier 22 parallel to the pole axis. The pole is laterally braced using guy wires 15. There are several drawbacks with guy wires. Firstly, there is no effective way to test the holding strength of the guy against tensile forces. Second, guy wires take up a relatively large lateral footprint (see FIG. 18) as the guy wires must be extended a distance from the pole and are connected near the upper end of the pole. Third, guy wires do not resist compressive loading. Thus, two guy wires in opposition are required to laterally brace in opposing directions. Fourth, over time the guy wires stretch and sag, leading to weakened lateral stabilizing.

By contrast, guy wires can be replaced with a second screw pile screwed in at a non-zero angle to the utility pole axis. Several advantages may be realized over guy wires. Firstly, lateral brace loading strength can be quantified and tested by monitoring torque applied to the screw piles 18 during insertion and stopping insertion after the torque applied exceeds a predetermined value. Second, the angled screw pile takes up less lateral space and gives a relatively smaller footprint as a result, see FIG. 18 for example. Such a result may be particularly important for example if the pole is adjacent roadways, pipelines, or thick vegetation. Such a result is also possible because the screw pile can be connected near the base of the pole and simply screwed far enough into the ground until the desired holding strength is achieved. Third, screw piles resist tensile and compressive loading. Screw piles may have flights 23 or other lateral protrusions like threads, which grip the soil to resist tensile (pull out) and compressive (push in) loading. Fourth, screw piles are rigid and do not sag or stretch over time. Fifth, screw piles used in the disclosed methods and apparatuses are cheaper and more efficient to install than a comparable guy wire arrangement. Sixth, the labor costs for guy wire installation are relatively higher, in some cases seventy percent higher, than for a screw pile. In some cases there is also a difference of about forty percent decrease in production time when installing a screw pile as opposed to installing two guy anchors and extension rods in unstable or soft soil.

Figure 8:
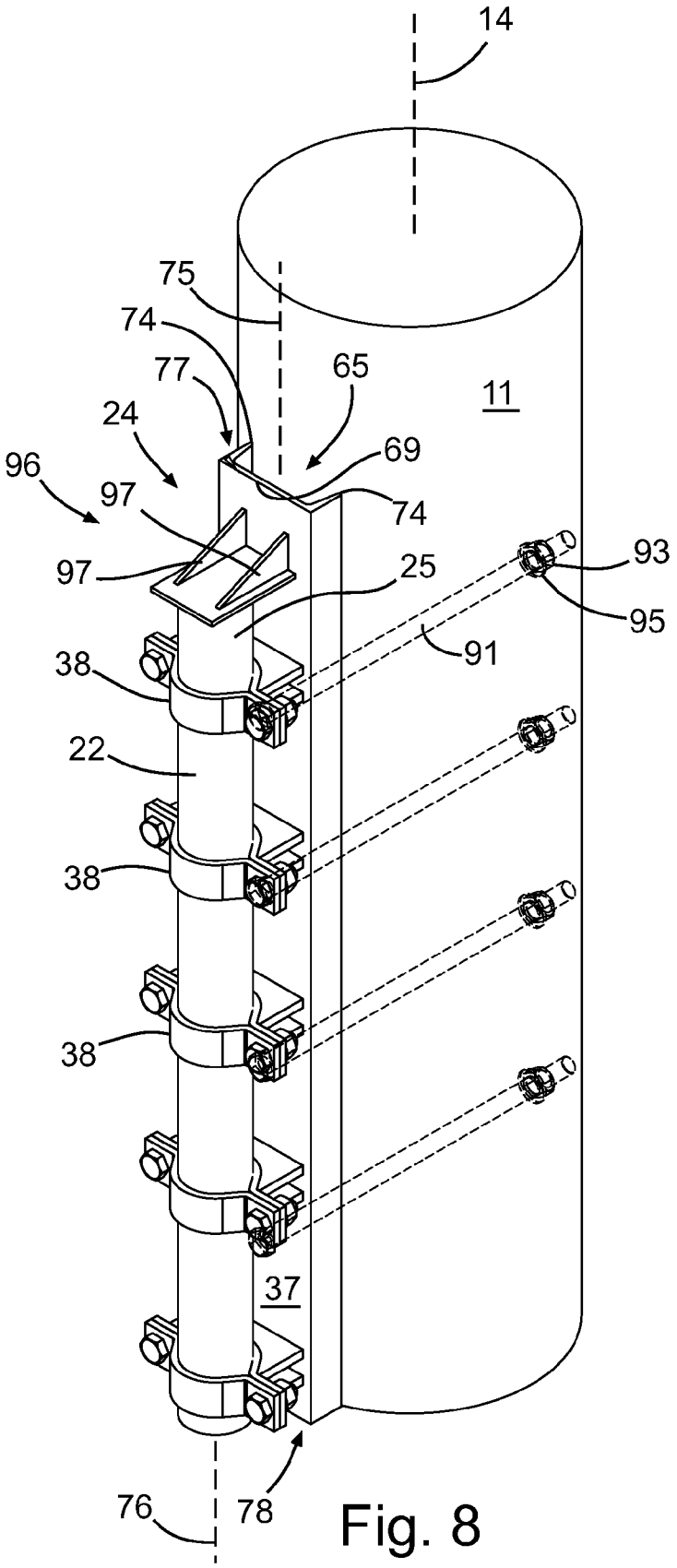
FIG. 8 is a perspective view of another embodiment of a bracket used to connect a screw pile to a utility pole.

Referring to FIGS. 8-18 a further embodiment of a bracket 24 is illustrated. The clamp 38 comprises a series of clamps 38 axially aligned and spaced from one another along the plate 37 (FIG. 8). The clamps 38 may collectively define a screw pile shaft axis 76, which may be parallel to a utility pole axis 75 defined by the channel 65. In use in this example the utility pole axis 75, the screw pile shaft axis 76, and the axis 14 of the utility pole 11 itself after installation, are all parallel to one another. The channel 65 runs from a first end 77 to a second end 78 of the plate 37, with the clamps 38 being spaced along the plate 37 from first to second ends 77 and 78. The length of channel 65 from end to end 77-78 may be five feet in one example. The dimensions of the channel 65 may be selected such that the edges 74 contact the utility pole 11 in use, while a portion of the base part 69 of the channel 65 may or may not contact the utility pole 11. Thus, all or a substantial portion of the gripping force of the bracket 24, excepting the force from the bolts 91, may be focused along the relatively narrow surface area of the edges 74, leading to a stronger bite along edges 74 than if the force were dispersed across a surface area the size of the base part 69.

Figure 12:
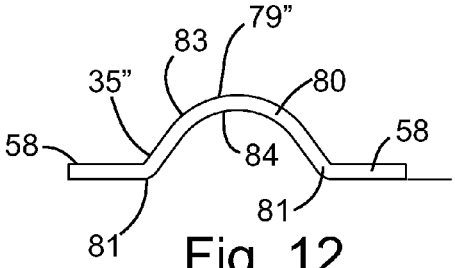
FIG. 12 is an end elevation view of an outer screw pile receiving part of the clamp of the bracket of FIG. 8.
Figure 13:
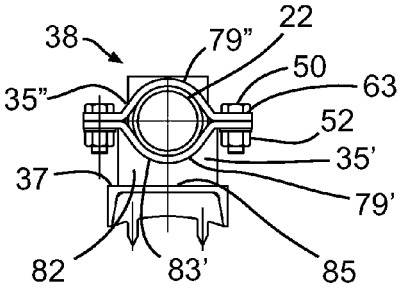
FIG. 13 is an end elevation view, in section, of the clamp of the bracket of FIG. 8 used to clamp a screw pile shaft.
Figure 14:
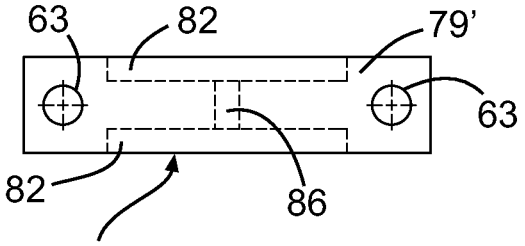
FIG. 14 is a top plan view of the inner screw pile receiving part of the clamp of the bracket of FIG. 8, with dashed lines used to illustrate plates used to secure the part to the bracket plate.
Figure 15:
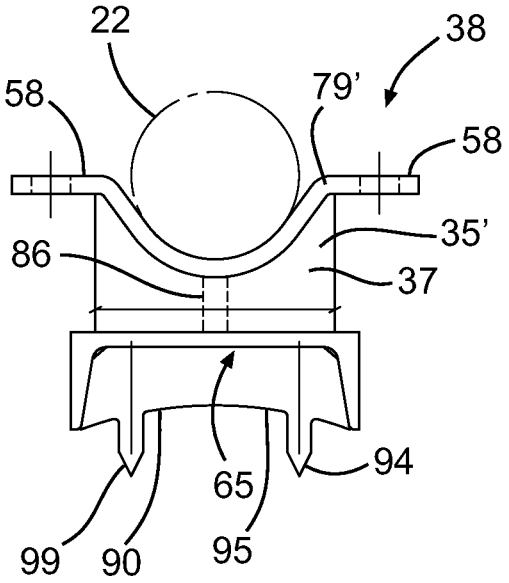
FIG. 15 is an end elevation view of the inner screw pile receiving part of FIG. 14, with a screw pile shaft shown in dashed lines.
Figure 16:
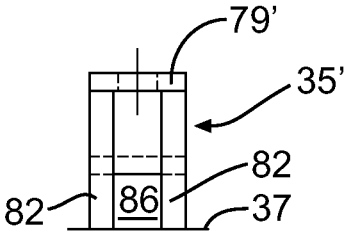
FIG. 16 is a side elevation view of the inner screw pile receiving part of FIG. 14.
Figure 17:
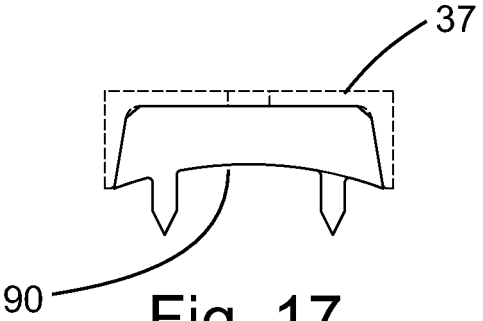
FIG. 17 is an end elevation view of a stiffener located within the plate channel of the bracket of FIG. 8.

Referring to FIGS. 12-16, the structure of the clamp 38 is illustrated. At least one of the screw pile shaft receiving parts, in this case 35', may be fused to the plate 37, for example by welding or other integral connection. In the example shown parts 35' and 35" include first and second omega-shaped pieces 79' and 79", respectively. Referring to FIG. 12, the second omega piece 79" is shown and described, although the first piece 79' shares many common features with piece 79" in this example. Piece 79" has a pipe receiver 80 with a C-shaped cross-section, and connected along both edges 81 of pipe receiver 80 are laterally extending flanges 58. Omega piece 79" has a back surface 83 and a pipe gripping inner surface 84. Omega pieces 79 may be formed by bending a single piece of metal in some cases. Referring to FIG. 13, omega piece 79' may be reinforced by one or more plates 82 extended, for example welded, perpendicularly from respective back surfaces 83 of omega pieces 79. Referring to FIGS. 13, 14, and 16, in the example shown two spaced fins or plates 82 are extended perpendicularly between back surface 83 of omega piece 79', and an outer surface 85 of plate 37. A plate, such as a flat bar 86, extends, for example by welding, between plates 82 for further reinforcement. Referring to FIG. 15, each plate 82 may connect to back surface 83 of piece 79' along the entire width of the pipe receiver 80 and at least part of each flange 58. Referring to FIGS. 13 and 14, each flange 58 carries a fastener receiver opening, such as bolt holes 63, for receiving bolts 50, which may be secured using nuts 52. In use, the size of the opening provided by clamp 38 for screw pile 22 is selected such that fastening the flanges 58 together produces compressive forces against screw pile 22, to apply a friction hold on pile 22 against axial thrusting.

Figure 9:
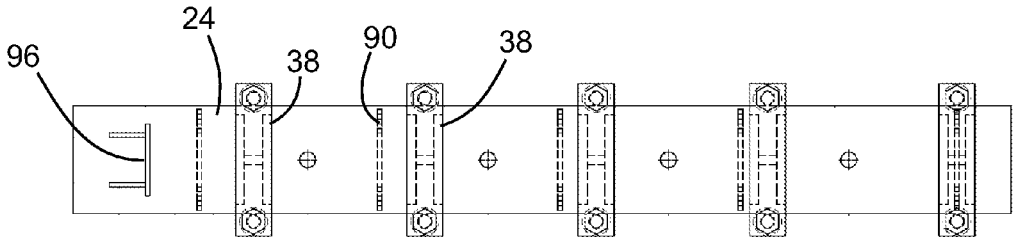
FIG. 9 is a top plan view of the bracket of FIG. 8.
Figure 10:
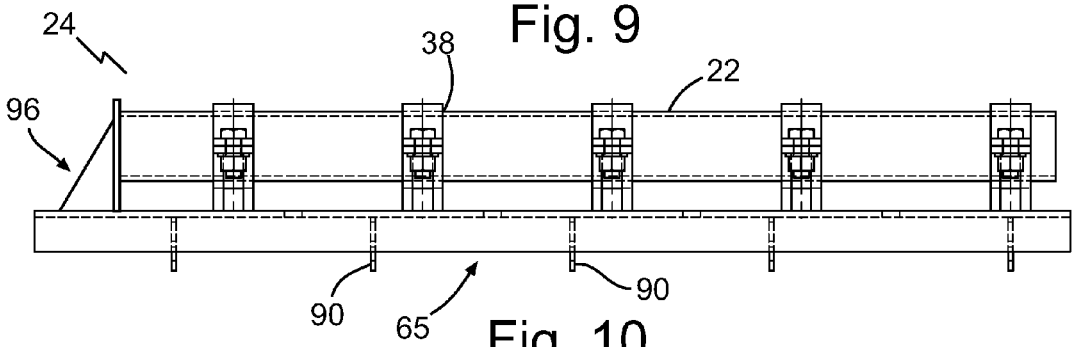
FIG. 10 is a side elevation view of the bracket of FIG. 8.
Figure 11:
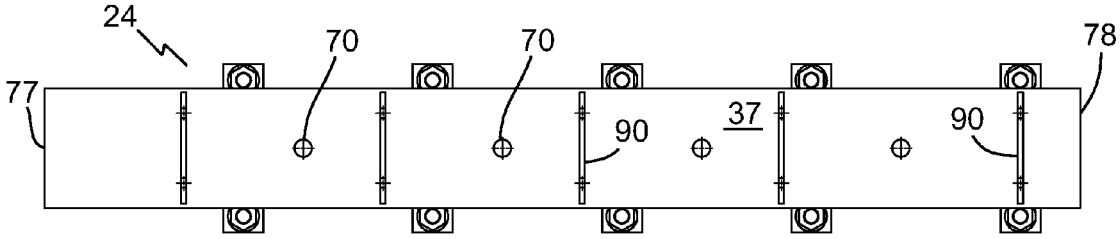
FIG. 11 is a bottom plan view of the bracket of FIG. 8.

Referring to FIGS. 9, 10, 11, and 15, a series of stiffeners 90 may be located within the channel 65. Referring to FIG. 15, each stiffener 90 may be a plate as shown, extended, for example by welding, perpendicularly across channel 65. Each stiffener 90 may have a utility pole contacting edge 92 that is curved to follow a portion of an outer circumferential surface of a utility pole 11. Each stiffener may comprise a utility pole penetrating pin or pins 94. Pins 94 act like nails, and allow the bracket 24 to be initially secured to utility pole 11 by for example pressing pins 94 into utility pole 11 by suitable force such as hammering plate 37. Stiffeners 90 and pins 94 act as sheep dogs that take some axial load off of bolts 91 (FIG. 11). Referring to FIG. 11, stiffeners 90 and bolt holes 70 may be staggered along the length of the plate 37 from first end 77 to second end 78. Bolts 91 pass through holes 70 and corresponding holes in utility pole 11, emerging from the opposite side of utility pole 11 where nuts 93 and washers 95 may be used to secure bolts 91, and plate 37, in place. Pins 94 also prevent sliding of the plate 37 along the utility pole 11.

Referring to FIGS. 8-10, bracket 24 may have a screw pile thrust stop, such as a plate 96, secured to the plate 37. Plate 96 may be positioned across the screw pile shaft axis 76 defined by the clamp 38. Thus, plate 96 blocks or limits the axial travel of a shaft 25 of screw pile 22 through clamps 38. The plate 96 may effectively cap the shaft conduit defined collectively by the clamps 38. The plate 96 may be reinforced by one or more brace plates 97 extended, for example by welding, between plate 37 and plate 96, for example perpendicular to both plates 37 and 96. The plate 96 prevents vertical thrust of the screw pile 22 relative to the utility pole 11, and allows the utility pole 11 to effectively sit on top of the pile 22.

Referring to FIG. 18, a combination of a bracket 24', utility pole 11, and screw pile 22' is illustrated. The bracket 24' is secured to the utility pole 11, for example by bolting as described above. The screw pile 22' is fastened to the clamps 38 and penetrates the ground surface 12 vertically, parallel to the utility pole 11. A lateral stabilizer, such as the combination of a second screw pile 22" and the bracket 24" described in FIGS. 2-7, may be connected to the utility pole 11. Other later stabilizers may be used, such as one or more guy wires 15. The utility pole 11 is positioned above or partially within unstable soil 26, and the unstable soil is one or more of permafrost, soils with ice lensing, muskeg, soil with organics, water saturated soils, silts, sands, peat, hog fuel, wood chips, and weak alluvial soils. Insertion of screw pile 22' into soil 26 may be carried out before or after securing the plate 37 to the utility pole 11, for example using bolts 91 as described above. Once the plate 37 is secured to the utility pole 11, and the screw pile 22' inserted into the soil 26 with sufficient torque to found the base 48 of the utility pole 11, the pile 22' may be connected to the clamps 38, for example as described above. The bracket 24' may be positioned such that a top end 98 of the screw pile 22 contacts the plate 96 of the thrust stop mechanism. In some cases the thrust stop plate 96 may be connected in a fashion that allows fine positioning of the stop relative to the plate 37, or relative to the utility pole 11, after the plate 37 is secured to the utility pole 11. In some cases the thrust stop plate 96 may be connected to plate 37 after securing the plate 37 to the utility pole 11. Bolts, such as bolts 91 and 50, may secure the bracket 24' to the utility pole 11 or fasten the screw pile 22 to the clamps 38 with an installation torque at or above 150 Newton meters.

Referring to FIG. 18, a second screw pile 22" may penetrate the ground surface 12 and be secured by bracket 24" to the utility pole 11 at a base 48 of the utility pole 11 above the ground in a batter pile configuration relative to the utility pole 11 as shown. Referring to FIG. 19, plural second screw piles 22" may be secured at various radially spaced locations about a utility pole 11 circumference. For example, three piles 22" are positioned at 120 degree intervals about a utility pole 11 circumference.

Figure 20:
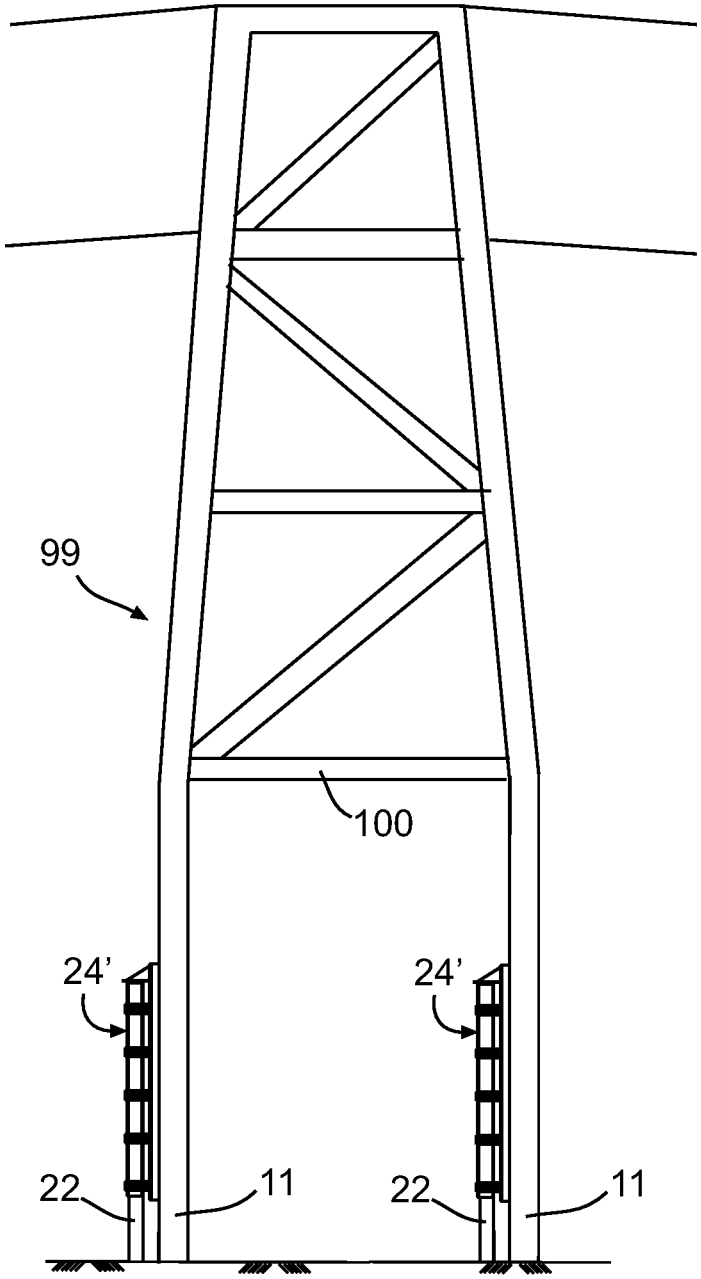
FIG. 20 is a side elevation view of the brackets from FIG. 8 used on utility poles that make up a distribution or transmission tower.

Referring to FIG. 20, a transmission or distribution tower 99 mounted in unstable soils is illustrated, with base utility poles 11 each with a bracket 24 secured to the utility pole 11 and mounting a vertical screw pile 22. The lateral connections 100 between utility poles 11 may provide lateral stabilization to the utility poles 11, while the screw piles 22 provide thrust, sinking, and lateral strength to the tower 99. The disclosed method of founding a distribution or transmission tower is a replacement for previous methods of founding such towers, for example using more complicated and expensive bucket pile foundation methods.

Using a vertical bracket such as bracket 24' may be more expensive than the traditional vertical support method illustrated in FIG. 1 with bolts 31. However, additional strength is added to the screw pile 22 in the axial and lateral directions. In addition, the strength of the screw pile 22 itself is not comprised because there is no need to drill holes in the screw pile itself when using bracket 24'. The bracket 24' also spaces screw pile 22 a distance away from pole 11, as opposed to directly adjacent pole 11, increasing the lateral support provided by the pile 22, and making installation of screw pile 22 easier to accomplish because the pile 22 is not directly adjacent the pole 11. Bracket 24' also distributes load off of bolts 91 used to secure screw pile 22 to pole 11, thus increasing shear resistance and longevity.

All of the methods disclosed here may be used for permanent or temporary installation of screw piles 16 and 18 to brace utility pole 11. One or both of screw pile 16 or 18 may be telescopic. The first and second screw piles 16 and 18, respectively, may be inserted at the same time or in a suitable order of insertion. Screw piles 16 and 18 may be connected to the utility pole 11 at the same time or in a suitable order of connection. The utility pole 11 may be installed after one or both of screw piles 16 and 18 are inserted. The position of screw pile 16 as being parallel to the utility pole 11 includes at least nominal deviations from parallel. In some cases screw pile 16 need not be parallel, and may be at a non-zero angle relative to the utility pole axis.

Use of screw piles 16 and 18 restricts lateral utility pole tipping as well as vertical jacking. The apparatus 10 may be designed to withstand a lateral force greater than the breaking strength of the utility pole 11. The first screw pile 16 may be positioned underneath the utility pole 11 as a foundation base. Wherever mechanisms such as bolts or other securing mechanisms are discussed, it should be understood that other suitable connection mechanisms may be used, for example welding, nailing, adhesive, and others. Although described above with respect to a utility pole, other utility poles may be used in the apparatuses and methods disclosed here. Screw pile 18 may in some cases be installed through a bracket 24 after bracket 24 is partially secured to utility pole 11. Apparatus 10 in FIG. 2 is set up for a tangent installation relative to the conductor wire, although other installations may be used. In some embodiments, inserting may comprise extending or pounding. An insertion hole (not shown) may be drilled prior to insertion of either screw piles 16 or 18.

The word plate in this document is not limited to a flat object. Other non-bolt fasteners may be used to secure flanges 58. In some cases a hinge may be provided between two cooperating flanges 58, with the opposite cooperating flanges 58 connecting by bolting or another suitable fastening mechanism. Vertical includes nominal deviations from vertical and is used as a relative word. C-shaped includes U-shaped. The utility pole 11 may have a circular cross sectional shape.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A bracket comprising:

a plate having bolt holes and a utility pole mount, with the bolt holes positioned to, in use, receive bolts that pass into a utility pole;

a clamp secured to the plate, the clamp comprising cooperating screw pile shaft receiving parts having screw pile gripping inner surfaces connected to laterally extending flanges, the laterally extending flanges having fastener receiving openings for securing the clamp around a screw pile; and the clamp having a gripping position where the screw pile gripping inner surfaces collectively define a passageway that is open at both ends, with fastener receiving openings of adjacent laterally extending flanges aligned in pairs to receive fasteners to, in use, draw the screw pile gripping inner surfaces together around a screw pile to apply a compressive force against the screw pile and restrict axial movement of the screw pile into and out of the passageway, and in which the utility pole mount comprises a utility pole penetrating pin, the plate has axial ends and opposed faces between the axial ends, the utility pole mount and the utility pole penetrating pin extend from one of the opposed faces, and the clamp extends from the other of the opposed faces.

2. The bracket of claim 1 in which at least one of the cooperating screw pile shaft receiving parts is fused to the plate.

3. The bracket of claim 1 in which the utility pole mount is a channel formed by the plate and having a C-shaped cross-sectional shape.

4. The bracket of claim 3 in which the clamp defines a screw pile shaft axis, which is parallel to a utility pole axis defined by the channel.

5. The bracket of claim 3 further comprising a series of stiffeners located within the channel.

6. The bracket of claim 5 in which each stiffener has a utility pole contacting edge that is curved to follow a portion of an outer circumferential surface of a utility pole.

7. The bracket of claim 5 in which each stiffener comprises a respective utility pole penetrating pin.

8. The bracket of claim 1 in which the clamp comprises a series of clamps axially aligned and spaced from one another along the plate.

9. The bracket of claim 1 further comprising a screw pile thrust stop secured to the plate.

10. The bracket of claim 9 in which the screw pile thrust stop comprises a plate positioned across a screw pile shaft axis defined by the clamp.

11. A combination comprising:

a bracket that has:

a plate having bolt holes and a utility pole mount;

a clamp secured to the plate, the clamp comprising cooperating screw pile shaft receiving parts having screw pile gripping inner surfaces connected to laterally extending flanges, the laterally extending flanges having fastener receiving openings for securing the clamp around a screw pile; and the clamp having a gripping position where the screw pile gripping inner surfaces collectively define a passageway that is open at both ends, with fastener receiving openings of adjacent laterally extending flanges aligned in pairs to receive fasteners to, in use, draw the screw pile gripping inner surfaces together around a screw pile to apply a compressive force against the screw pile and restrict axial movement of the screw pile into and out of the passageway;

a utility pole extended from a ground surface, in which the plate is bolted to the utility pole through the bolt holes in the plate; and a screw pile fastened to the clamp by being gripped by the screw pile gripping inner surfaces of the clamp while the clamp is in the gripping position, the screw pile penetrating the ground surface.

12. The combination of claim 11 in which bolts securing the bracket to the utility pole or fastening the screw pile to the clamp are installed to an installation torque at or above 150 Newton meters.

13. The combination of claim 11 in which the utility pole is positioned above or partially within unstable soil that is one or more of permafrost, soils with ice lensing, muskeg, soil with organics, water saturated soils, silts, sands, peat, hog fuel, wood chips, and weak alluvial soils.

14. The combination of claim 11 in which the screw pile is a first screw pile, and further comprising a second screw pile penetrating the ground surface and secured by bracket to the utility pole at a base of the utility pole above the ground in a batter pile configuration relative to the utility pole, in which the first screw pile is mounted parallel to a utility pole axis.

15. The combination of claim 14 in which the second screw pile comprises plural second screw piles secured at various radially spaced locations about a utility pole circumference.

16. The combination of claim 11 in which at least one of the cooperating screw pile shaft receiving parts is fused to the plate.

17. The combination of claim 11 in which the utility pole mount is a channel formed by the plate and having a C-shaped cross-sectional shape.

18. The combination of claim 17 in which the clamp defines a screw pile shaft axis, which is parallel to a utility pole axis defined by the channel.

19. The combination of claim 11 further comprising a screw pile thrust stop secured to the plate.

20. The combination of claim 11 comprising:

the screw pile being fastened to the clamp and penetrating the ground surface along an axis that is parallel to a utility pole axis; and a lateral stabilizer connected to the utility pole;

in which the utility pole is positioned above or partially within unstable soil, and the unstable soil is one or more of permafrost, soils with ice lensing, muskeg, soil with organics, water saturated soils, silts, sands, peat, hog fuel, wood chips, and weak alluvial soils.

* * * * *